US005607154A

United States Patent [19]

Meumann et al.

[11] Patent Number: 5,607,154

[45] Date of Patent: Mar. 4, 1997

[54] BLADE REPLACEMENT SYSTEM FOR HOCKEY STICKS

[76] Inventors: Richard E. Meumann, 25392 Helena Cir., Mission Viejo, Calif. 92691; Richard C. Meumann, 31805 Oak Glen Rd., Valley Center, Calif. 92082

[21] Appl. No.: 513,096

[22] Filed: Aug. 9, 1995

[51] Int. Cl.[6] ..... A63B 59/12

[52] U.S. Cl. ..... 473/562; 16/108; 473/563

[58] Field of Search ..... 273/67 R, 67 A, 273/80.2, 80.3, 80.4, 80.5, 290; 16/108, 109

[56] References Cited

U.S. PATENT DOCUMENTS

| | | | |
|---|---|---|---|
| D. 260,854 | 2/1981 | Sergeant | D8/395 |
| D. 299,693 | 2/1989 | Wick | D8/396 |
| D. 344,559 | 2/1994 | Ilacqua et al. | D21/210 |
| 3,537,275 | 11/1970 | Smith | 273/80.2 X |
| 3,934,875 | 1/1976 | Easton et al. | 273/67 A |
| 3,961,790 | 6/1976 | Milligan | 273/67 A |
| 4,086,115 | 4/1978 | Sweet, Jr. et al. | 273/67 A X |
| 4,299,413 | 11/1981 | Neher | 285/114 |
| 4,361,325 | 11/1982 | Jansen | 273/67 A |
| 4,524,848 | 12/1989 | Graham | 16/115 |
| 4,888,721 | 12/1984 | Franck et al. | 273/67 A |
| 5,024,438 | 1/1991 | Candow | 273/81 R |
| 5,312,100 | 5/1994 | Ilacqua et al. | 273/67 A |

*Primary Examiner*—William H. Grieb

*Attorney, Agent, or Firm*—Knobbe, Martens Olson & Bear

[57] ABSTRACT

A hockey stick replacement system includes a coupler adapted to receive a wooden hockey stick shaft at one end and a replacement blade at the other; the replaceable blade being made of either conventional wood or of aluminum. The aluminum replaceable blade possesses a textured blade surface and is contoured to emulate a conventional wooden hockey stick blade. The system allows players to attach new blades onto previously broken wooden sticks, thus preserving the life of a wooden stick shaft, and permits the use of different types of blades depending upon the performance level desired.

15 Claims, 6 Drawing Sheets

BLADE REPLACEMENT SYSTEM FOR HOCKEY STICKS

FIELD OF THE INVENTION

The present invention relates generally to a hockey stick blade replacement system and method for connecting replaceable blades onto hockey stick shafts.

BACKGROUND OF THE INVENTION

Ice hockey and roller hockey are both popular sports enjoyed worldwide. While played on different playing surfaces, both sports employ very similar equipment, including hockey sticks. Like many athletes, one problem faced by hockey players involves finding and using the best equipment available while keeping equipment costs low.

For many hockey players, the largest budgetary expense is buying and replacing hockey sticks. During the course of a game, a hockey stick can impact the playing surface hundreds of times, often at force levels equal to the maximum level for which the stick was designed. Hence, it is not uncommon for experienced players to break one or more sticks during each game. In many cases, a hockey stick breaks at the hozel portion of the blade (the lower shaft portion immediately above the blade), thus leaving the majority of the shaft undamaged. Disadvantageously, once a stick is broken, the hockey player must discard the entire hockey stick (shaft and blade), even though the shaft is otherwise in perfect condition. Additionally, the game's inherently physical nature often results in chipping and splintering of the hockey stick blade. Even though technically usable, a splintered blade is not effective and is usually discarded as well.

For decades, wood has been the conventional material used for hockey sticks. Many players have grown accustomed to the feel of a wooden shaft, as it is the only material most hockey players have ever used. Due to its wide scale use, many stick manufacturers have been reluctant to invest in alternative materials that emulate the "feel" of a wooden stick. Wood, however, has drawbacks. Only 5–10% of a given tree will yield lumber that has the lightness, stiffness, and grain uniformity suitable for use as hockey sticks. This is neither economically nor ecologically efficient. The skilled labor required to handcraft parts of these sticks is expensive. Wood varies from tree to tree, and sticks made to the same specifications may feel and play quite differently.

While a wooden shaft is advantageous due to its flexural characteristics, a wooden blade is not always advantageous because it does not fully transfer the force of a shot to the puck; i.e., it is not highly efficient, depending upon the choice of wood or the dimensions of the blade. Due to its typically softer nature, as compared with metals, a wooden blade is also subject to damage easily.

Attempts have been made to minimize the damage caused to hockey sticks during normal usage. Players often tape the blades of their sticks to prevent splitting and splintering of the wood blades. Taping the blade slows the wear associated with surface abrasion but does nothing to prevent against breakage. In addition, blades have been made with different materials, including thermoplastics that can be heated and/or mechanically attached to shafts of broken sticks. U.S. Pat. No. 4,488,721 to Franck discusses the use of kevlar, graphite, or fiberglass blades possessing thermoplastic cores. These synthetic materials, however, tend to wear poorly on abrasive surfaces like asphalt or concrete; common playing surfaces for street hockey in particular and roller hockey in general.

Manufacturers have also begun to use aluminum shafts with detachable blades, permitting the replacement of blades if necessary. The drawback is that aluminum shafts are expensive and many players prefer the feel of a wooden shaft.

Despite these efforts, none have solved the problem of maximizing the use of a wooden shaft stick by repairing damaged hockey sticks for reuse. While systems have been designed that permit the attachment of replacement blades to hollow hockey stick shafts, none are applicable to wooden shafts. Nor has there been an effective solution to the problem of maximizing the life of a hockey stick blade while improving performance. With wood, there is no guarantee that the same dimension and feel will result each time. Moreover, wooden blades do not permit the kind of customization that permits a user to maximize performance.

OBJECT OF THE INVENTION

It is therefore an object of the present invention to enhance the useful life of wooden hockey stick shafts by eliminating the need to discard entire wooden hockey sticks that have broken blades. It is another object of the present invention to improve upon the design of a replacement blade that is usable with a wooden hockey stick shaft to enhance the performance and durability of hockey sticks as a whole.

SUMMARY OF THE INVENTION

The present invention is a hockey stick replacement system that comprises a coupler having first and second opposing ends adapted to receive a wooden hockey stick shaft at one end and a replacement blade at the other, the replaceable blade being made of either conventional wood or of aluminum; the latter possessing a textured blade surface and contoured to emulate a conventional wooden hockey stick blade.

The system improves on the prior art by having a coupler that allows players to attach new blades onto previously broken wooden sticks and further permits the use of different types of blades depending upon the performance level desired, thus preserving the life of a wooden stick shaft. The invention also improves durability by using a hockey stick blade made of aluminum that will not easily splinter, break, or wear. An aluminum blade improves performance because it is stiffer than conventional wooden, composite, or thermoplastic blades, thus transferring the force of a shot to the puck more effectively. The present invention also includes a blade surface having a textured face that generates more puck spin and control. With castable or machinable metals, consistency in the feel and playing characteristics of the resulting product is improved through the controllable nature of the manufacturing process. Furthermore, after they are replaced, the aluminum blades have the additional feature of being recyclable.

DETAILED DESCRIPTION OF THE INVENTION

Reference is now made to the figures wherein like parts are designated with like numerals throughout.

Figure 1:
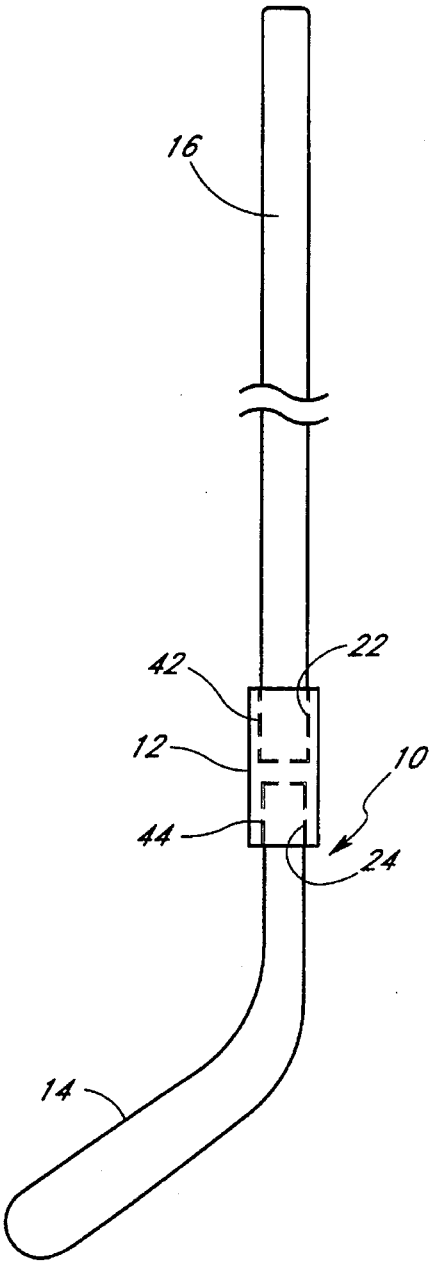
FIG. 1 illustrates the hockey blade replacement system as applied to a hockey stick shaft.
Figure 2:
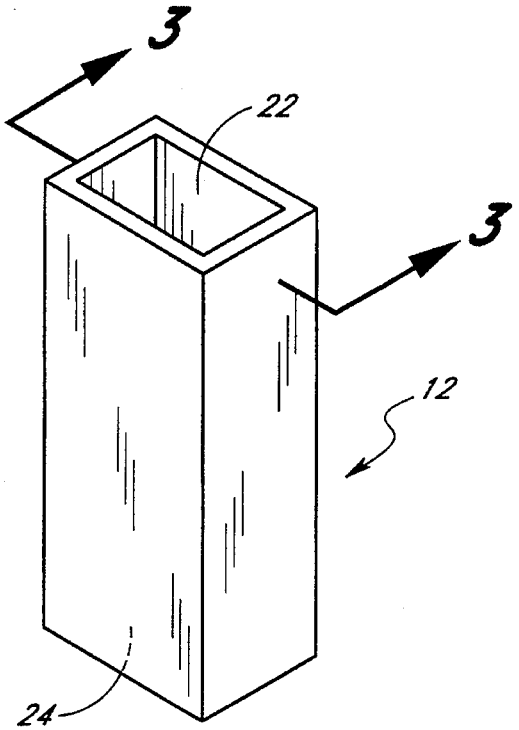
FIG. 2 is a perspective view of one embodiment of the coupler portion of the present replacement system.
Figure 3:
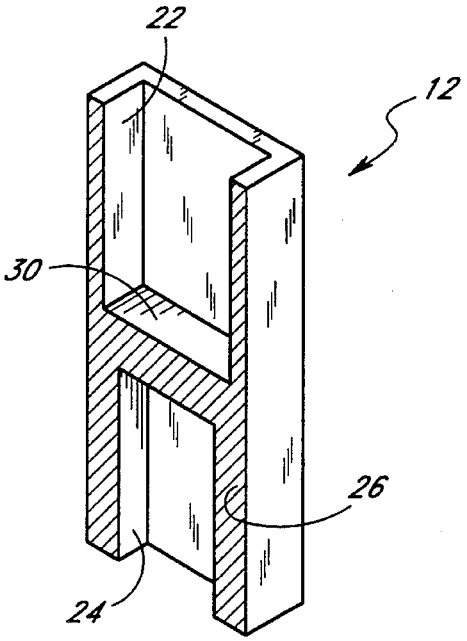
FIG. 3 is a perspective cross-sectional view of FIG. 2 as reflected by section 3—3 in FIG. 2.

Referring to FIG. 1, the present hockey stick replacement system 10 comprises a coupler portion 12 configured to fit between one embodiment of a replacement blade 14 and a hockey stick shaft 16. As shown in FIG. 2, the coupler portion 12 preferably has a rectangular housing and may be made of any material such as metal, fiberglass, plastic or a composite thereof, such metals including but not limited to aluminum, magnesium, titanium, stainless steel and high temperature alloys. The coupler portion 12 is at least partially hollow and functions as a linking mechanism for the hockey stick shaft 16 and the replacement blade 14. In one embodiment, the coupler portion 12 has openings 22 and 24 at opposing ends to receive the hockey stick shaft 16 and the hockey stick blade 14, respectively. Where desired, the two opposing ends 22, 24 may have different cross-sectional dimensions in order to accommodate a shaft and a blade hozel (top portion of the blade) of different dimensions, as shown in FIG. 3. The dimensions of ends 22 and 24 may be equal for replacement blades having hozel dimensions equal to those of a hockey stick shaft. Preferably, in either case, the dimensions of the openings 22, 24 are sized to be just slightly larger than the respective dimensions of a hockey stick shaft and a replacement blade hozel in order to permit a tight fit. When implemented, the present system should leave substantially no room for play between the stick shaft and the blade.

The stick shaft and replacement blade may be affixed to the coupler portion 12 via an adhesive to keep the components from separating in a linear direction. Other means for joining those components to the coupler portion include mechanical fasteners, or a press fit process whereby the coupler is heated, to expand the openings to fit over the shaft and replacement blade, and is then cooled to shrink fit about both components, although this latter process may not work as well for non-metals. A tight fit enhances the ability of the coupler to prevent the components from separating due to flexure of the entire stick.

Figure 4A:
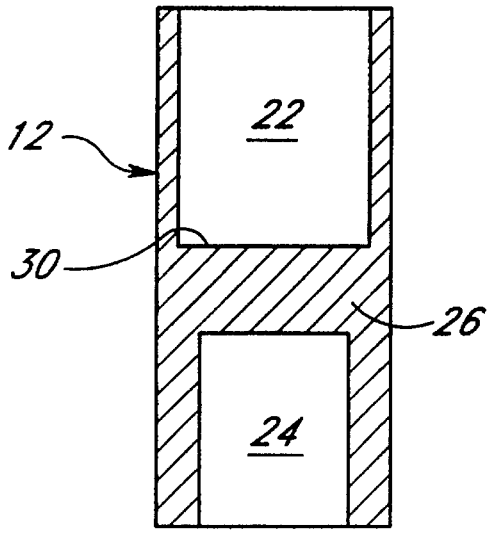
FIG. 4A is an elevational cross-sectional view of the embodiment of FIG. 2 as reflected by section 3—3.

Referring to the embodiment of FIGS. 3 and 4A, the coupler portion 12 has an outer wall 26 of uniform outer dimension, whereby the wall thickness varies depending upon the inner cross-sectional dimension of the openings 22 and 24. FIGS. 3 and 4A illustrate one embodiment of the coupler portion 12 that employs a spacer 30 that separates openings 22 and 24 to prevent direct engagement of the end of the hockey stick shaft and the replacement blade hozel. In the modified embodiment of FIG. 4B, the coupler portion 12 does not employ a spacer but, rather, employs a tapered shoulder 32 that functions as a stop for the hockey stick shaft (or replacement blade if so desired) and permits fluid communication between openings 122 and 124.

Figure 4B:
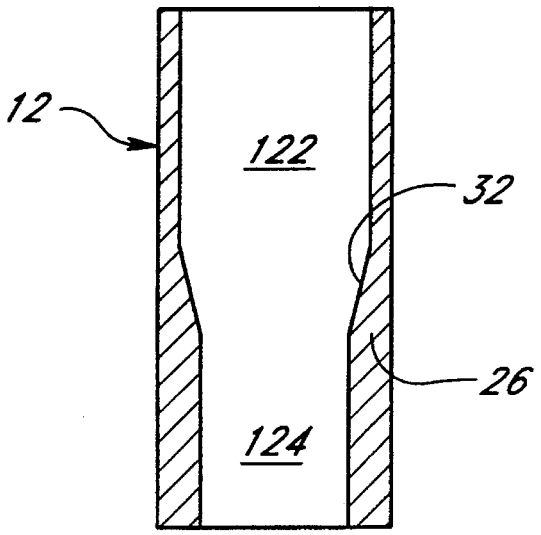
FIG. 4B is an elevational cross-sectional view of a slightly modified embodiment of the embodiment of FIG. 4A as reflected by section 3—3 in FIG. 2.
Figure 5A:
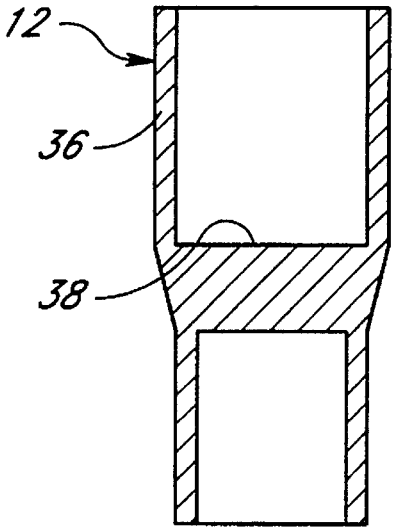
FIG. 5A is an elevational cross-sectional view of another embodiment of the coupler portion of the present invention viewed from a perspective similar to that of FIG. 4A.
Figure 5B:
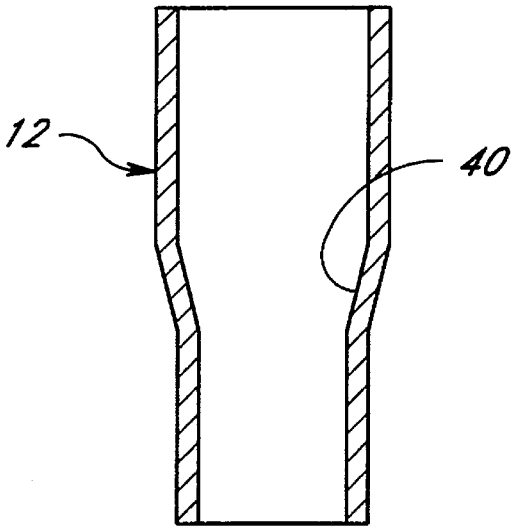
FIG. 5B is an elevational cross-sectional view of a slightly modified embodiment of the embodiment of FIG. 5A viewed from a perspective similar to that of FIG. 4B.

Referring to FIGS. 5A and 5B, another embodiment of the present coupler portion 12 is shown employing outer walls 36 of generally uniform thickness but non-uniform outer dimensions that requires lesser material in the walls and allows for a lighter coupler portion. For certain materials, a thinner wall is desired and still functions effectively to smoothly transfer the force of the hockey stick shaft to the blade (and vice versa). Analogously to FIG. 4B, FIG. 5B illustrates a modified version of embodiment in FIG. 5A, wherein the embodiment of FIG. 5A employs a spacer 38 and the modification of FIG. 5B employs a tapered shoulder 40.

Figure 6:
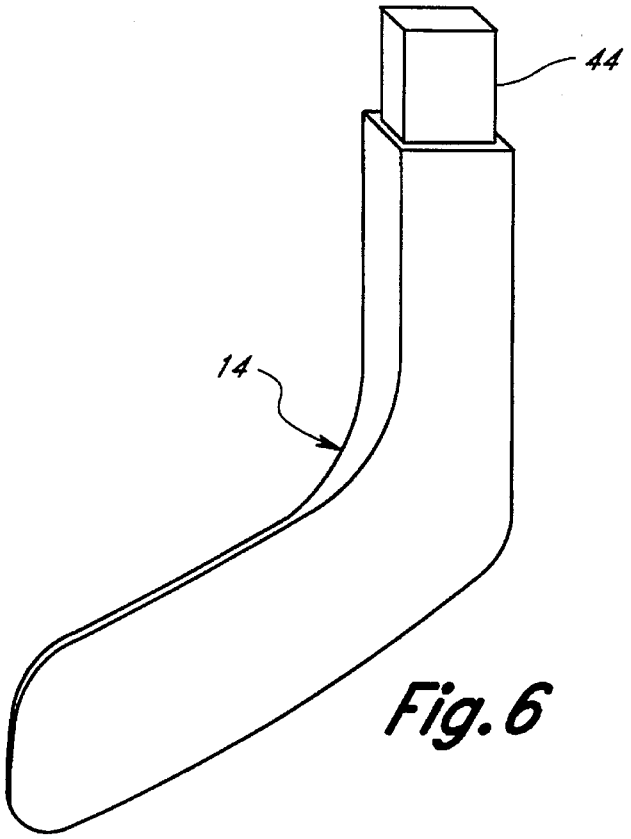
FIG. 6 is a perspective view of one embodiment of a solid replacement hockey stick blade compatible with the coupler portion of the present system.

It is contemplated that when a wooden hockey stick breaks close to the hozel of the stick, that the shaft be cleanly cut just above the break to provide a "squared off" connecting end 42, as shown in phantom in FIG. 1. That shaft connecting end 42 may then be inserted into opening 22 of coupler portion 12 as shown to snugly fit therewithin. While it is possible that the remaining broken blade may be refinished to create a hozel for insertion into opposing opening 24 of coupler portion 12, it is more likely that the user must discard the broken blade as unusable. Under those circumstances, the user can employ a replaceable blade contemplated by the present invention, said replaceable blade having a finished hozel 44, shown in phantom in FIG. 1 and directly in FIG. 6, that is capable of mating with opposing opening 24 for a snug fit therewithin.

Figure 7:
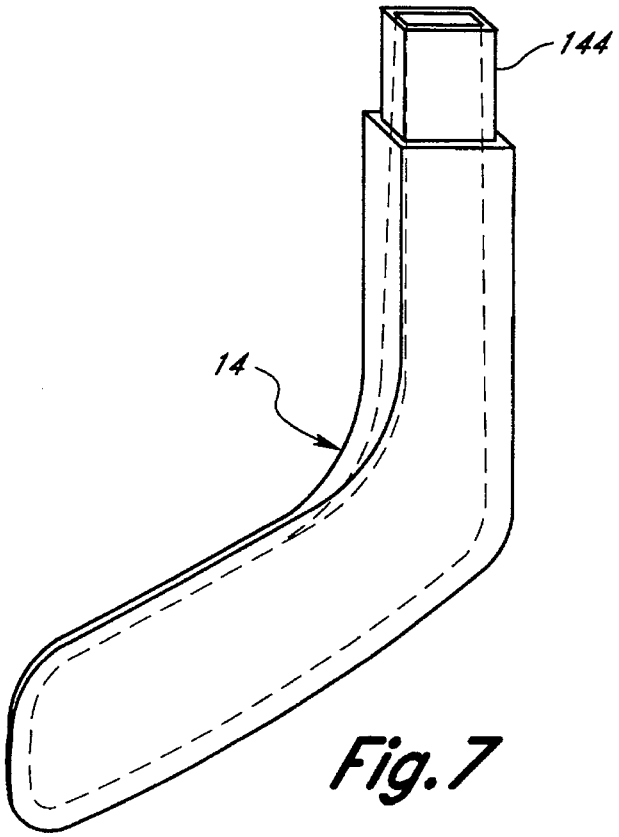
FIG. 7 is a perspective view of one embodiment of a hollow replacement hockey stick blade compatible with the coupler portion of the present system.

The present invention replacement system 10 comprises a replacement blade that is either solid, hollow, honeycombed, or comprised of metal laminates over a lightweight non-metal core material. Such core material may comprise a honeycomb material. The replacement blades of the present invention are preferably made of any metal such as aluminum, titanium, magnesium, stainless steel, high temperature alloys, or any other alloy of these same or similarly durable metals; preferably materials having properties of light weight and/or high strength and hardness. For solid replacement blades, such as that shown in FIG. 6, the blade may be fabricated by any one of a number of methods including, but not limited to, cast, forged or cold-rolled. For hollow replacement blades, such as that shown in FIG. 7, a number of fabricating techniques may be used, as described below. Importantly, in contrast to wooden blades, a metal blade fabricated as described herein or equivalently thereto can be reproduced virtually identically in dimension, weight and shape every time. This feature gives the avid hockey player an advantage in that, once a particular material and configuration is selected as being optimal for that player's needs, he is assured of having a plurality of replacement blades that are virtually identical in construction, thus, permitting maximum effectiveness as a player over the long term, regardless of how often he must replace the blade. By employing the coupler portion 12 with any one of the embodiments of a replacement blade 14 described herein, the player will dramatically improve the life of his hockey stick with the expense of frequent replacements. The player will also experience the improved control and power associated with a metal replacement blade compatible with the coupler portion.

Figure 8:
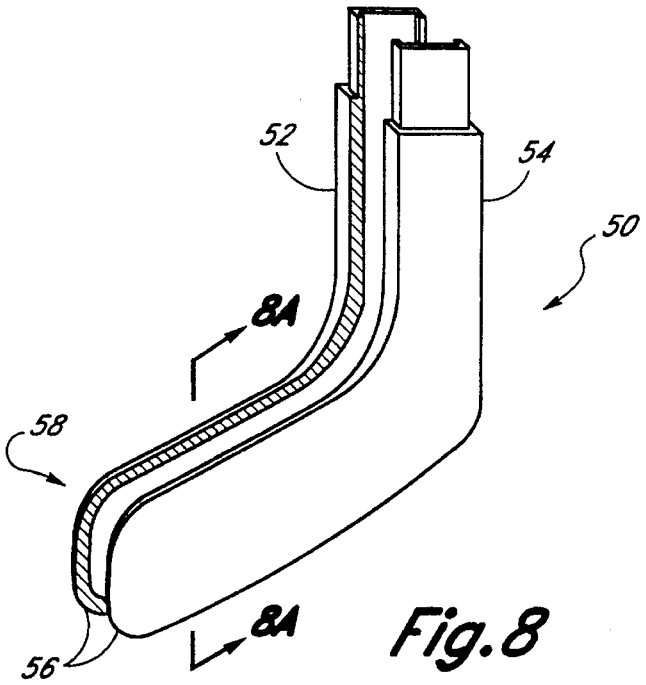
FIG. 8 is a perspective view of one alternative embodiment for fabricating the hollow replacement blade of FIG. 7 wherein the embodiment comprises two discrete sections that may be mechanically linked via one of several methods.

As shown in FIG. 8, one of several alternative fabricating techniques is illustrated in constructing a hollow replacement blade contemplated by the present invention. In the embodiment of FIG. 8, the hollow replacement blade 50 comprises two, discrete, thinly walled, sections 52 and 54 that are configured to mate to form a virtually seamless blade via one of several mechanical connections. With hollow replacement blade 50, the blade sections 52 and 54 are preferably welded along the seams 56 conforming to the contour of the blade so that the seam 56 is not positioned on either puck hitting surfaces 58 (not shown) and 60, as illustrated in FIG. 8A.

Figures 8A, 8B, 8C:
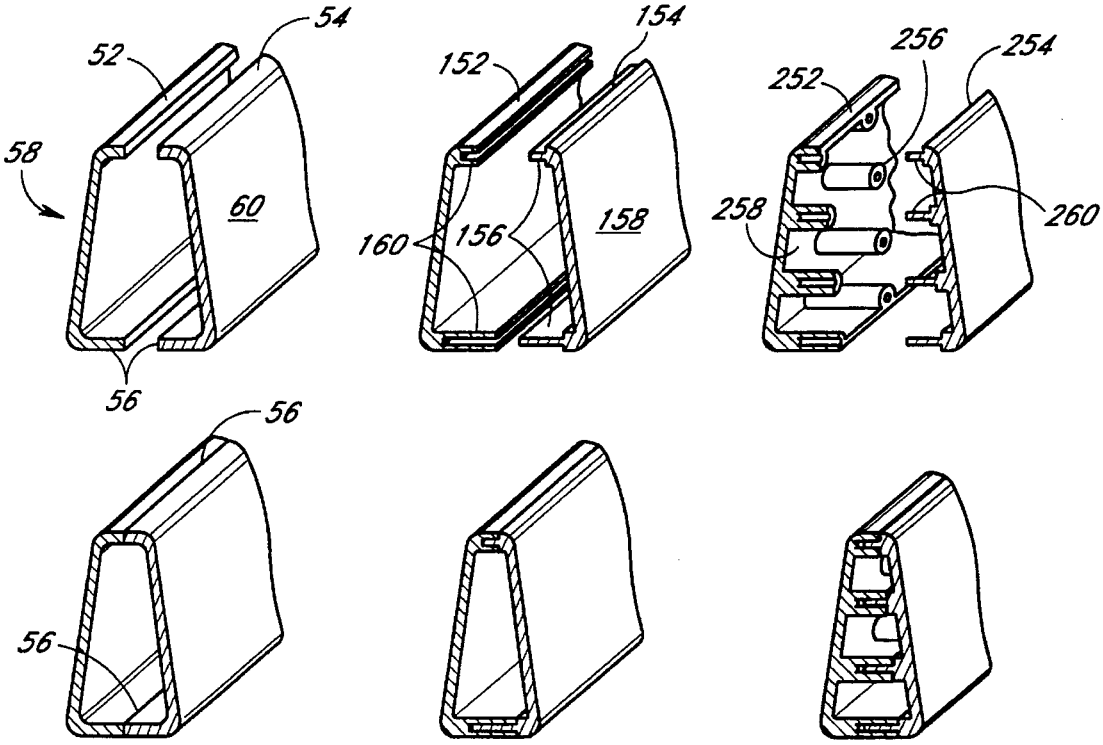
FIG. 8A illustrates two cross-sectional views of one embodiment for connecting the two discrete blade sections of FIG. 8, the top view showing the discrete blade sections in a pre-joined position and the bottom view showing the blade sections mechanically linked together, said cross section taken along line 8A—8A of FIG. 8.
FIG. 8B illustrates two cross-sectional views of another embodiment for connecting the two discrete blade sections of FIG. 8, the top view showing the discrete blade sections in a pre-joined position and the bottom view showing the blade sections mechanically linked together, said cross section taken along line 8A—8A of FIG. 8.
FIG. 8C illustrates two cross-sectional views of still another embodiment for connecting the two discrete blade sections of FIG. 8, the top view showing the discrete blade sections in a pre-joined position and the bottom view showing the blade sections mechanically linked together, said cross section taken along line 8A—8A of FIG. 8.

As an alternative to welding, sections 152 and 154 may employ various mechanical mating features such as a co-linear tongue and groove channel shown in FIG. 8B. With that embodiment, blade section 154 has a continuous tongue 156 positioned on the inside surface thereof, said tongue 156 positioned substantially perpendicularly to the striking surface 158 so as to mate with a corresponding groove channel 160 on the other blade section 152 similarly positioned thereon. The lower illustration of FIG. 8B shows this tongue and groove embodiment assembled.

FIG. 8C shows still another embodiment for joining two sections of a hollow replacement blade wherein the blade sections 252 and 254 have mating features that permit the sections to be snapped tightly together. Section 252 includes a plurality of raised apertures 256 integral with the inside surface 258 thereof. Blade section 254 similarly includes raised pins 260 that mate with apertures 256 when blade sections 252 and 254 are properly aligned, as shown in FIG. 8C.

After engagement of the blade sections, via any effective means, including those shown in FIGS. 8A through 8C, the replacement blade 50 of FIG. 8 may be molded in the toe region 60 of the blade 50 to form a left-handed or right-handed curve, as desired. It may also be desired to weld at least a portion of the resulting seams for the embodiments of FIGS. 8B and 8C.

It should be noted that blade sections 52 and 54 may include reinforcement means integral therewith or connected thereto to stiffen the hollow replacement blade in and around the striking surface. The reinforcement means can include stiffening ribs or gussets that will enhance the ability of the blade surface to resist the inward impact of a puck upon striking the puck. Examples of ribs are shown in FIGS. 9 through 9B and discussed below.

Figure 9:
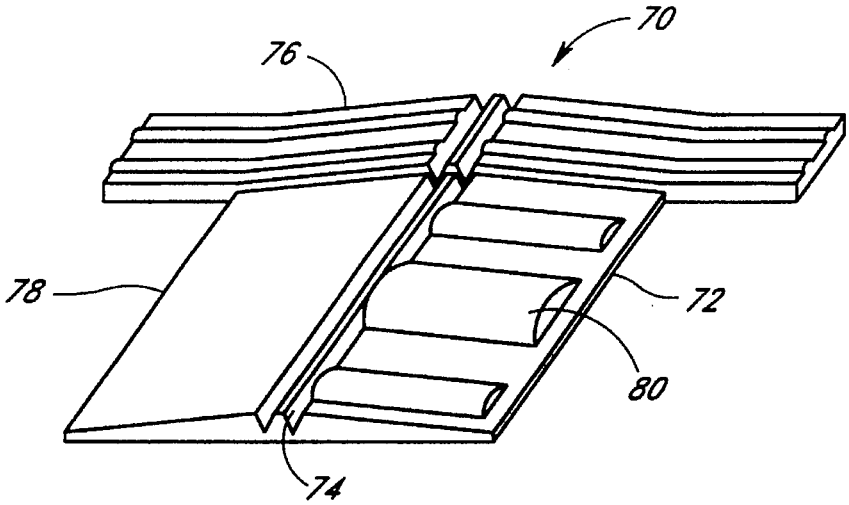
FIG. 9 is a perspective view of an another alternative embodiment for fabricating the hollow replacement blade of FIG. 7.

In an alternative fabrication technique for a hollow replacement blade 70, a single sheet of metal that is cast, rolled or press forged as a generally flat plate 72, as shown in FIG. 9. The flat plate 72 is preferably provided with one or more creases 74 along the symmetrical mid-section of plate 72 to facilitate bending of the plate 72 at the creases 74. The flat plate includes two main portions; a hozel portion 76 and a blade portion 78, both symmetrically cast. Preferably, the hozel portion 76 and the blade portion 78 are provided with internal ribs 80 of various dimension contemplated to stiffen the striking surface of the blade portion and to minimize bending of the hozel portion. Depending upon the material and the wall thickness chosen, the ribs 80 may also be desired so as to impart a striking force to the puck sufficient to improve upon the power that a player may exert upon the puck. Reinforcements should be placed primarily near the center or "sweetspot" of the blade as this area would have the highest pressures applied to it when impacting the puck. The ribs 80 may be integrally cast with the plate 72 or may be affixed to the plate 72, depending upon the desires of the manufacturer. The ribs 80 may also be oriented in a variety of ways, as well.

Figure 9A:
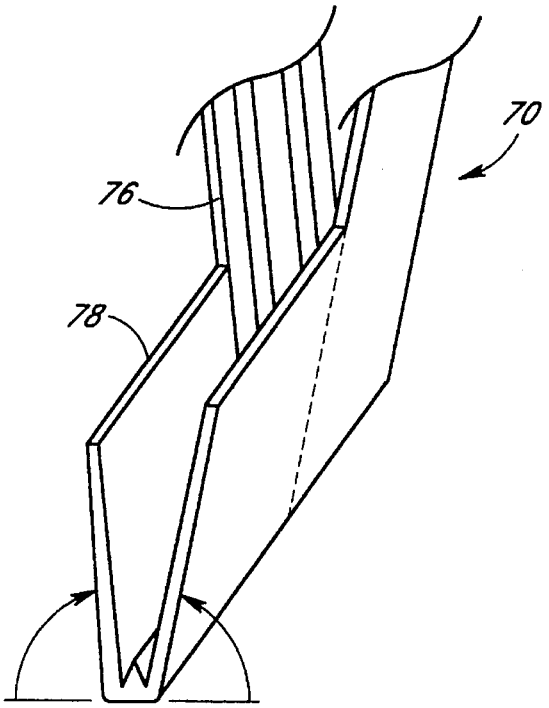
FIG. 9A is a cross-sectional perspective view of the embodiment of FIG. 9 in a partially assembled position.
Figure 9B:
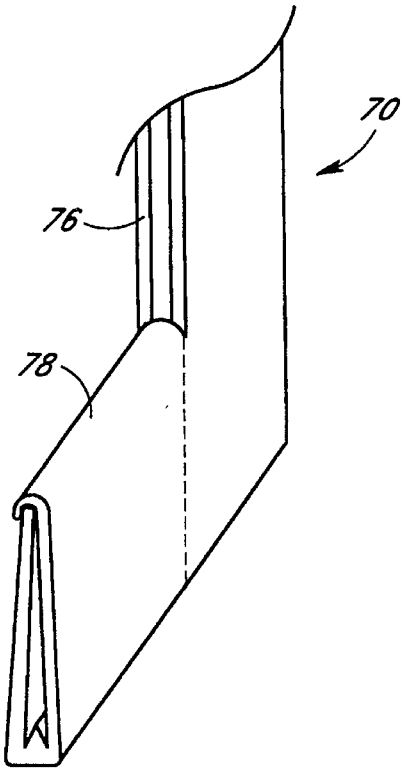
FIG. 9B is a cross-sectional perspective view of the embodiment of FIG. 9 in a fully assembled position.

As shown in FIG. 9A, the flat plate 72 may then be folded to form the replacement blade 70 of FIG. 9B. The flat plate 72 may be engaged in a sealed manner via any of mechanical means illustrated and described in connection with FIGS. 8A–8C. As with the embodiments of FIGS. 8A–8C, the embodiment of FIG. 9B may then be molded at the toe region 82 of the blade 70 to form a left-handed or right-handed curve, as desired.

Figure 10A:
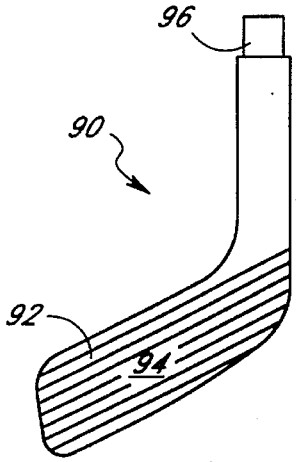
FIG. 10A is a front view of one embodiment of a textured blade surface employable with either a solid or hollow blade compatible with the coupler portion of the present system.
Figure 10B:
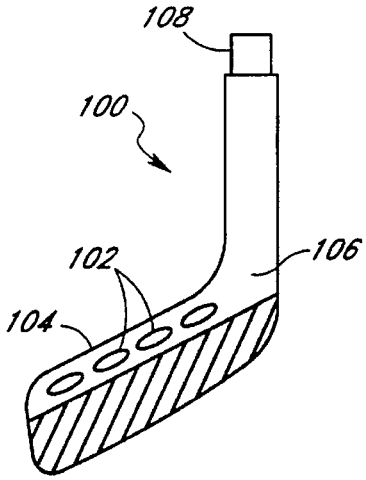
FIG. 10B is a front view of one embodiment of a textured blade surface employable with either a solid or hollow blade compatible with the coupler portion of the present system.
Figure 10C:
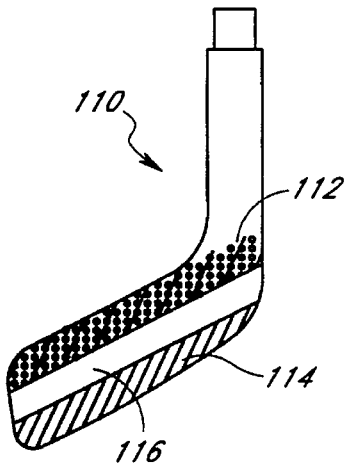
FIG. 10C is a front view of one embodiment of a textured blade surface employable with either a solid or hollow blade compatible with the coupler portion of the present system.

Referring to FIGS. 10A–C, it is contemplated that the replacement blade 50 of the present system includes a blade surface 58 that may incorporate one or more textures to enhance puck handling and shooting performance. The type of surface texturing can affect the ability of the blade to control and impart spin on the puck, and thus the blade in the present invention comes with various types of surface texturing, including those illustrated in FIG. 11 and described below.

FIG. 10A shows a replacement blade 90 in which the entire hitting surface 92 has a texture 94 of choice. The blade 90 includes a finished hozel 96 for insertion into the coupler portion 12 described above and illustrated in FIGS. 2–5B.

FIG. 10B illustrates an embodiment designed reduce weight and aerodynamic drag during the swinging motion of the stick without compromising the blade's structural integrity. The replacement blade 100 of FIG. 10B may be manufactured with a plurality of holes 102 along the top portion 104 of the blade surface 106. The holes 102 may be of various shapes and sizes depending upon the manufacturer's or user's desires. It is also contemplated that the holes have a tapered inner surface so that the circumferential dimension on one side of the blade are smaller than those on the opposite side. Again, the replacement blade 100 includes a finished hozel 108 to mate with coupler portion 12.

FIG. 10C shows still another embodiment of replacement blade 110 having a plurality of textured surfaces 112 and 114 with, if desired, a smooth surface 116 therebetween. It is contemplated that any combination of textured surfaces may be used depending upon the responsiveness of surfaces to a player's shooting and handling abilities.

Figure 11:
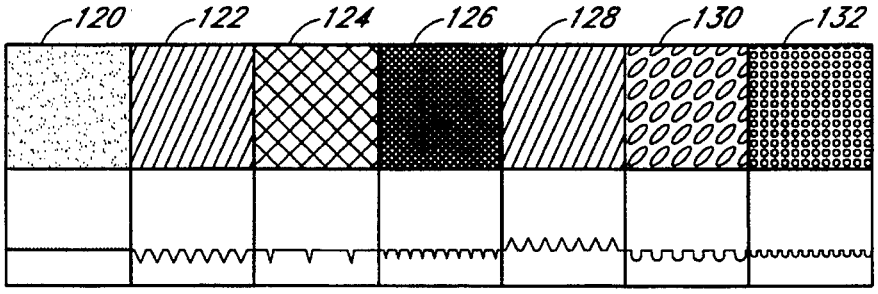
FIG. 11 is a table of some of the textured blade surfaces contemplated with the present invention illustrated in the top row of the table a cross-sectional view of each textured surface as applied to a blade illustrated in the bottom row of the table.

Referring now to FIG. 11, various possible blade surface textures are shown including, but not limited to sandpaper 120, grooved 122, cross-hatched 124, herring-boned 126, ribbed 128, elliptically dimpled 130 and spherically dimpled 132. A cross-sectional view of each of the textured surfaces is shown in FIG. 11 directly below the top view of the textured surfaces identified above. It should be noted that these, and other textured surfaces not specifically identified herein, may be applied to both the front surface of a replacement blade as well as the back surface, permitting greater control for back-handed shots as well.

The invention herein also includes a method of preparing a hockey stick shaft and a hockey stick blade to enhance the life of a hockey stick. Referring to FIG. 1, the present method includes the steps of cutting off a damaged portion of a hockey stick shaft 16 to create a cleanly prepared connecting end 42 for receiving a coupler portion 12 having first and second connections 22, 24 at opposing ends, wherein said first connection 22 is adapted to receive the connecting end 42 of hockey stick shaft 16 and wherein said second connection 24 is adapted to receive a hozel end of a replacement blade 14; trimming the connecting end 42 to permit a binding fit with said coupler portion 12; trimming a hozel end 44 of a hockey stick replacement blade (if necessary) to ensure a binding fit with said coupler portion 12; and, connecting (e.g., using adhesive, mechanical fasteners, press fit) the connecting end 42 of the shaft 16 and the hozel end 44 of the hockey stick blade 14 to the coupler portion 12.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed:

1. A high durability, high performance hockey stick blade replacement system suitable for use with a hockey stick shaft, said system comprising:

a hockey stick blade having a textured surface on at least a portion thereof, said blade shaped substantially like conventional replacement hockey stick blades and having a hozel portion at one end; and a coupler portion having first and second connections at opposing ends wherein said first connection is adapted to receive one end of the replacement blade and said second connection is adapted to receive one end of a hockey stick shaft;

whereby said replacement system permits repair of damaged hockey sticks that would otherwise be discarded and thereby lengthens the useful life of a hockey stick shaft, said system also enhancing puck control and manufacturable reproducibility.

2. The system of claim 1 wherein the hockey stick blade includes one or more holes to reduce blade weight and/or aerodynamic drag.

3. The system of claim 1 wherein the hockey stick blade is at least partially hollow.

4. The system of claim 3 further comprising one or more internal reinforcements.

5. A hockey stick blade replacement system comprising a replaceable hockey stick blade made of metal, said metal blade configured to resemble conventional hockey stick blades and having at least a partially textured surface, said metal blade having a hozel at one end thereof configured to permit engagement of said metal blade with a hockey shaft coupler.

6. The system of claim 5 wherein the hockey stick blade includes one or more holes to reduce blade weight and/or aerodynamic drag.

7. The system of claim 5 wherein the hockey stick blade is at least partially hollow.

8. The system of claim 7 further comprising one or more internal reinforcements.

9. The system of claim 5 further comprising a hockey shaft coupler having first and second connections at opposing ends wherein said first connection is adapted to receive one end of the replaceable hockey stick blade and said second connection is adapted to receive one end of a hockey stick shaft.

10. A hockey stick blade replacement system suitable for use with a hockey stick shaft, said system comprising:

a replaceable metal hockey stick blade shaped substantially like conventional replacement hockey stick blades, and a coupler portion having first and second connections at opposing ends wherein said first connection is adapted to receive one end of the replacement blade and said second connection is adapted to receive one end of a hockey stick shaft;

whereby said replacement system permits repair of damaged hockey sticks that would otherwise be discarded and thereby lengthens the useful life of a hockey stick shaft, said system also enhancing puck control and manufacturable reproducibility.

11. The system of claim 10 wherein the hockey stick blade includes one or more holes to reduce blade weight and/or aerodynamic drag.

12. The system of claim 10 wherein the hockey stick blade is at least partially hollow.

13. The system of claim 12 further comprising one or more internal reinforcements.

14. A method for attaching hockey stick blades to hockey sticks comprising the steps of:

cutting off a damaged portion of a hockey stick shaft to create a connecting end for receiving a coupler portion having first and second connections at opposing ends;

trimming a connecting end to permit a binding fit with said coupler portion;

applying adhesive to a hozel end of a replaceable hockey stick blade to ensure a binding fit with said coupler portion;

applying adhesive to the connecting end of the shaft; and inserting both the connecting end of the shaft and the hozel end of the hockey stick blade into the coupler portion.

15. A hockey stick blade replacement system suitable for use with a hockey stick shaft, said system comprising:

a replaceable hockey stick blade shaped substantially like conventional replacement hockey stick blades and having a hozel portion at one end;

a coupler portion having first and second connections at opposing ends wherein said first connection is adapted to receive the hozel portion of the replacement blade and said second connection is adapted to receive one end of a hockey stick shaft;

whereby said replacement system permits repair of damaged hockey sticks that would otherwise be discarded and thereby lengthens the useful life of a hockey stick shaft, said system also enhancing puck control and manufacture reproducility.

* * * * *